US006390763B1

(12) United States Patent
Prentice

(10) Patent No.: US 6,390,763 B1
(45) Date of Patent: May 21, 2002

(54) LIFT TRUCK CARRIAGE WITH IMPROVED SIDESHIFTER

(75) Inventor: Glenn Prentice, Milwaukie, OR (US)

(73) Assignee: Cascade Corporation, Fairview, OR (US)

( * ) Notice: Subject to any disclaimer, the term of this patent is extended or adjusted under 35 U.S.C. 154(b) by 27 days.

(21) Appl. No.: 09/584,332

(22) Filed: May 30, 2000

(51) Int. Cl.[7] ..... B66F 7/00; B66F 9/00
(52) U.S. Cl. ..... 414/667; 414/659; 414/785
(58) Field of Search ..... 414/607, 608, 414/667, 671, 785

(56) References Cited

U.S. PATENT DOCUMENTS

| | | | | |
|---|---|---|---|---|
| 2,650,733 A | | 9/1953 | Blatz | |
| 2,820,562 A | | 1/1958 | Schenkelberger | |
| 2,822,101 A | | 2/1958 | Schenkelberger | |
| 3,033,402 A | | 5/1962 | Leeper | |
| 3,122,252 A | * | 2/1964 | Jones | 414/785 |
| 3,241,698 A | | 3/1966 | Krett | |
| 3,512,671 A | | 5/1970 | Morocco | |
| 3,586,192 A | | 6/1971 | Goodacre | |
| 3,734,327 A | | 5/1973 | Ellis, Jr. | |
| 3,819,078 A | | 6/1974 | Walsh | |
| 3,974,927 A | | 8/1976 | Schuster | |
| 4,165,008 A | | 8/1979 | Faust et al. | |
| 4,185,944 A | | 1/1980 | Seaberg | |
| 4,279,564 A | | 7/1981 | Weinert | |
| 4,406,575 A | | 9/1983 | Gaibler | |
| 4,607,997 A | | 8/1986 | Asano | |
| 4,902,190 A | | 2/1990 | House | |
| 5,033,934 A | | 7/1991 | Emilio | |
| 5,147,171 A | | 9/1992 | Murray et al. | |
| 5,217,343 A | * | 6/1993 | Bostad et al. | 414/667 |
| 5,336,039 A | | 8/1994 | House | |
| 5,368,435 A | * | 11/1994 | Bostad et al. | 414/667 |
| 5,707,201 A | | 1/1998 | Hamlik | |
| 5,807,060 A | | 9/1998 | Hamlik | |

FOREIGN PATENT DOCUMENTS

| | | |
|---|---|---|
| DE | G8425528 | 11/1984 |
| DE | 4332185 | 3/1995 |
| JP | 56-12300 | 2/1981 |
| JP | 3-2560 | 1/1991 |
| JP | 7-10491 | 1/1995 |
| JP | 7-257895 | 10/1995 |
| JP | 2526445 | 6/1996 |
| JP | 2563219 | 9/1996 |
| JP | 8-324995 | 12/1996 |
| JP | 9-30791 | 2/1997 |
| JP | 2738266 | 1/1998 |

OTHER PUBLICATIONS

Cascade Corporation, "Integral Sideshifter," one page (1995).

"Linde Integral Sideshifter," three pages (1995).

* cited by examiner

*Primary Examiner*—Eileen D. Lillis
*Assistant Examiner*—Charles A Fox
(74) *Attorney, Agent, or Firm*—Chernoff, Vilhauer, McClung & Stenzel

(57) ABSTRACT

A lift truck sideshifting carriage has an upper transverse slide guide with an upwardly-protruding first lip for slidably supporting an upper transversely-extending slide of a sideshifting frame. The sideshifting frame has a second upwardly-protruding lip for supporting the load-handling implement of the lift truck. The slide guide has a transversely-extending reinforcing portion which protrudes forwardly from beneath a forwardly-facing surface of the first lip, and extends throughout at least a major portion of the transverse length of the slide guide. A sideshifting motor, for moving the sideshifting frame transversely with respect to the slide, is mounted to the slide guide externally beneath the reinforcing portion of the slide guide. The forwardly-protruding reinforcing portion of the slide guide and the upwardly-protruding first lip of the slide guide are formed monolithically and homogeneously as a single member.

14 Claims, 2 Drawing Sheets

LIFT TRUCK CARRIAGE WITH IMPROVED SIDESHIFTER

BACKGROUND OF THE INVENTION

The present invention relates to lift truck carriages which selectively shift a load transversely while the load is supported by a load-handling implement such as a pair of forks or a clamp. More particularly, the present invention is directed to improvements to such carriages for reducing their susceptibility to structural failure while compatibly maximizing operator visibility.

Lift truck sideshifting carriages have primarily been produced in two different forms. One form is an integral sideshifting carriage which has a built-in sideshifting structure and can mount a load-handling implement only on the sideshifting structure. The other form is a nonintegral sideshifting carriage which has a sideshifting structure detachably mounted thereon, and can mount a load-handling implement either with or without the sideshifting structure. In both forms of sideshifting carriage, transversely-extending, vertically-spaced upper and lower slide guides slidably support a sideshifting frame upon which the load and load-handling implement are supported in cantilevered fashion. The load is shifted transversely by a sideshifting motor, such as a hydraulic piston and cylinder assembly, which slides the sideshifting frame transversely along the slide-guides. The transversely-extending upper slide guide is subjected to high, fluctuating beam loading in a horizontal forward direction, to counteract the weight of the forwardly-cantilevered load. Such loading severely stresses the joints by which the slide guide is attached to a pair of transversely-spaced vertical side plates which movably engage the mast of the lift truck for lifting and lowering of the load, tending to cause fatigue failures at the joints.

The stresses from such cantilevered loading are increased as the height of the upper slide guide relative to the lower slide guide is decreased, because the vertical lever arm between the slide guides is decreased. Nevertheless, it has been common design practice to minimize the height of the upper slide guide to increase operator forward visibility over the top of the sideshifting frame, even though this decreases the visibility between the upper and lower slide guides because of the reduced space between them. These stress and visibility problems are particularly common in integral sideshifting carriages, where the sideshifting frame protrudes upwardly a significant distance above the upper slide guide to minimize forward protrusion of the sideshifting frame and thereby maximize the load-carrying capacity of counterbalanced lift trucks. The problems are further aggravated in integral sideshifting carriages by the common practice of enclosing a sideshifting motor within the upper slide guide, thereby dictating the size and shape of the slide guide and making it difficult to optimize its strength and size.

Accordingly, what is needed is an improved sideshifting carriage having an upper slide guide, sideshifting frame and sideshifting motor arranged so as to maximize strength and operator visibility compatibly.

BRIEF SUMMARY OF THE INVENTION

The present invention satisfies the foregoing need by providing a unique upper slide guide with an upwardly-protruding lip for slidably supporting the slide of a sideshifting frame, and a transversely-extending reinforcing portion which protrudes forwardly from beneath the forwardly-facing surface of the lip and extends throughout at least a major portion of the transverse length of the slide guide. A sideshifting motor engages the sideshifting frame so as to move the frame transversely with respect to the slide guide.

According to one independent preferred aspect of the invention, the sideshifting motor is preferably mounted beneath the reinforcing portion of the slide guide externally of the reinforcing portion.

According to another preferred independent aspect of the invention, the forwardly-protruding reinforcing portion of the slide guide and the upwardly-protruding lip of the slide guide are formed monolithically and homogeneously as a single member.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENT

Figure 1:
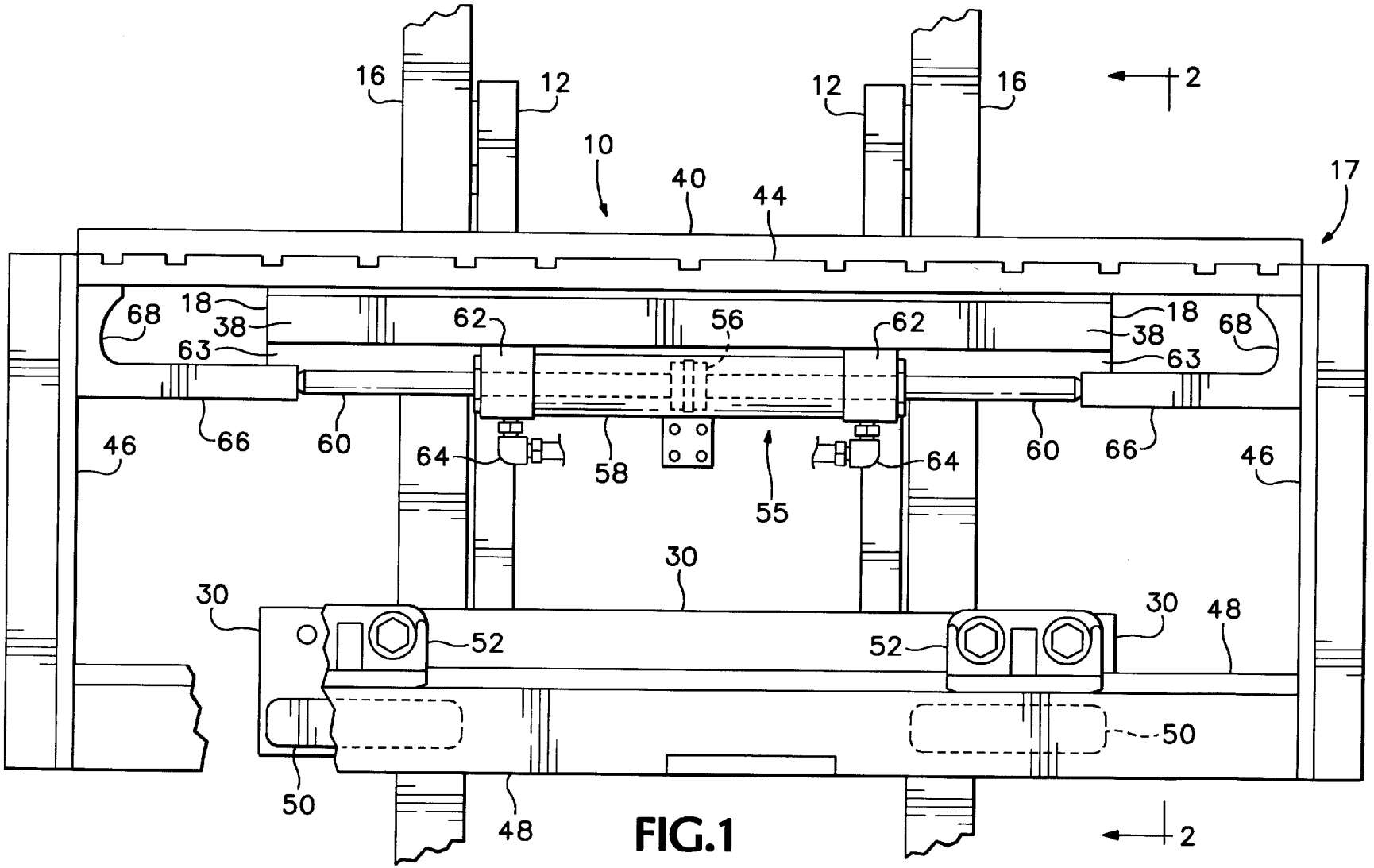
FIG. 1 is a front view of an exemplary preferred embodiment of a sideshifting carriage in accordance with the present invention.
Figure 2:
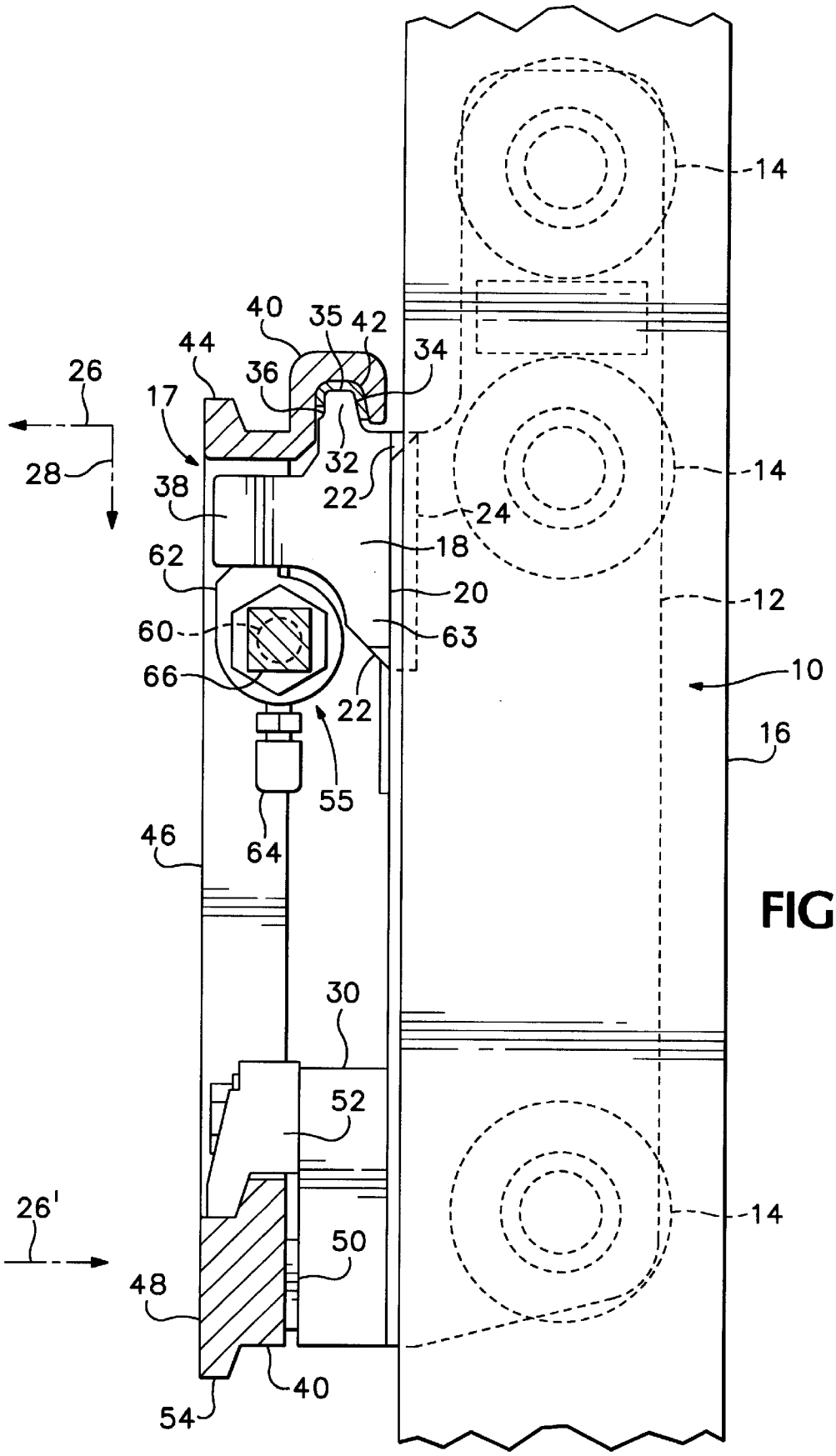
FIG. 2 is an enlarged, partially sectional side view taken along line 2—2 of FIG. 1.

A preferred integral sideshifting carriage in accordance with the present invention is designated generally as 10 in FIGS. 1 and 2. The carriage 10 comprises a pair of transversely-spaced, vertically-extending side plates 12 having vertically-spaced rollers 14 which movably engage transversely-spaced mast sections 16 of a conventional forklift truck so that the side plates 12 can be moved vertically by the mast to raise and lower a load (not shown). The load is supported by a conventional load-handling implement such as forks or a clamp (not shown) supported by a sideshifting frame 17 on the front of the sideshifting carriage 10. The loadhandling implement and load extend forwardly (to the left in FIG. 2),in cantilevered fashion from the sideshifting frame 17.

An elongate upper slide guide 18 transversely interconnects the side plates 16 at respective joints 20, preferably by means of horizontal fillet welds such as 22 and vertical fillet welds such as 24. The weld joints 20 and the transverse beam structure of the upper slide guide 18 must resist the forces imposed on the sideshifting frame 17 by the forwardly cantilevered load. These forces principally comprise a large, horizontal, forwardly-directed force 26 and a downward force 28, as shown in phantom in FIG. 2. A lower slide guide 30, which similarly interconnects the two side plates 12 at a location beneath the upper slide guide 18, resists a load-imposed rearwardly-directed horizontal force 26' equal and opposite to the upper horizontal force 26.

The upper slide guide 18 has a transversely-extending, upwardly-protruding first lip 32 having a rearwardly-facing lip surface 34, an upper lip surface 35, and a forwardly-facing lip surface 36. Protruding forwardly from beneath the forwardly-facing lip surface 36, and extending throughout at least a major portion of the length of the slide guide 18, is a transversely-extending reinforcing portion 38. Preferably, but not necessarily, the portion 38 is formed monolithically and homogeneously with the lip 32 as a single steel member which constitutes the upper slide guide 18.

The forwardly-protruding reinforcing portion 38 provides the upper slide guide 18 with a significantly improved beam strength to resist the load-imposed forces 26 and 28, particularly the forward horizontal force component 26 which tends to bend the slide guide 18 forwardly. Such improvement in beam strength is produced without increasing the vertical dimension of the upper slide guide 18, thereby making it possible to maximize the height of the slide guide 18, and thereby the vertical spacing and lever arm between the upper and lower slide guides, to minimize the magnitude of the horizontal force component 26 without thereby adversely affecting operator forward visibility over the top of the slide guide 18. The maximized vertical spacing between the upper and lower slide guides also optimizes the visibility between them. At the same time, the improved horizontal beam strength of the upper slide guide 18, and the resultant ability to maximize the height of the slide guide 18, reduce the load-imposed stresses at the joints 20 where the slide guide 18 is supported by the side plates 12, thus reducing the likelihood of fatigue failure at the joints 20.

The sideshifting frame 17 has at least one transversely-extending upper slide 40 which is slidably supported, through a slide bearing 42, by the upper surface 35 and rearwardly-facing surface 34 of the lip 32 to counteract the load forces 28 and 26, respectively. The upper slide 40 includes a transversely-extending, upwardly-protruding second lip 44 which supports conventional mating upper hooks (not shown) on the load-handling implement of the lift truck. The sideshifting frame 17 also includes a pair of transversely-spaced end plates 46 which depend vertically from the ends of the upper slide 40, and a transversely-extending lower slide 48 which interconnects the end plates 46 and slidably engages the lower slide guide 30 via slide bearings 50. The lower slide 48 is detachably retained in slidable abutment with the lower slider guide 30 by removable slide retainers 52, and includes a downwardly-depending lip 54 for engaging conventional mating lower hooks (not shown) on the load-handling implement.

The upwardly-protruding lip 44 of the upper slide 40 protrudes upwardly substantially no further than does the upwardly-protruding lip 32 of the upper slide guide 18, in keeping with the objective of minimizing the height of the top of the sideshifting carriage 10 for the reasons discussed previously. The reinforcing portion 38 of the upper slide guide 18 preferably protrudes forwardly to a location directly beneath at least a portion of the upwardly-protruding lip 44 so as to maximize the horizontal reinforcing effect of the portion 38. However, the portion 38 preferably does not protrude forwardly beyond the lip 44 since this would diminish the load-carrying capacity of a counterbalanced lift truck by moving the position of the load forwardly.

A sideshifting motor 55, preferably comprising a double-acting fluid-powered piston and cylinder assembly having a piston 56, a surrounding cylinder 58 and a pair of piston rods 60, is bolted by means of cylinder end caps 62 preferably beneath the reinforcing portion 38 of the slide guide 18 externally thereof. Preferably, the motor 55 is directly in front of a downwardly protruding portion 63 of the slide guide 18 which extends throughout at least a major portion of the length of the slide guide. Alternatively, the sideshifting motor 55 could be some other type of reciprocating motor, such as a ball screw or rack-and-pinion motor, and either fluid-powered or electrically-powered. Such mounting of the motor 55 externally of the slide guide 18 enables the cross section of the slide guide 18 to be optimized with respect to its strength and size characteristics, while also enabling maximum-height placement of the slide guide without interfering with good operator visibility.

A pair of fluid hose fittings 64 selectively conduct pressurized fluid alternatively to either side of the piston 56, thereby causing the piston to move the piston rods 60 either to the right or to the left in FIG. 1. The ends of the piston rods 60 abut a pair of stops 66 which are part of corner reinforcement members 68 on the sideshifting frame 17. Thus movement of the piston 56 either to the right or to the left in FIG. 1 transmits sideshifting motion to the sideshifting frame which, in turn, selectively shifts the load-carrying implement supported by the lip 44 of the sideshifting frame.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sideshifting carriage for vertically lifting and lowering a forwardly-extending load-handling implement and selectively shifting said implement transversely, said carriage comprising:

(a) transversely-spaced, vertically-extending side plates;

(b) at least one elongate slide guide transversely fixed to said side plates, said slide guide having a transverse length and a transversely-extending, upwardly-protruding first lip with a rearwardly-facing lip surface and a forwardly-facing lip surface, said slide guide further having a transversely-extending reinforcing portion protruding forwardly from beneath said forwardly-facing lip surface throughout at least a major portion of said length of said slide guide;

(c) a sideshifting frame including at least one transversely-extending slide which is slidably supported by said rearwardly-facing lip surface so as to be movable transversely with respect to said slide guide, said slide having a transversely-extending, upwardly-protruding, implement-supporting second lip thereon;

(d) a sideshifting motor engaging said sideshifting frame so as to move said frame transversely with respect to said slide guide;

(e) said sideshifting motor being mounted beneath said reinforcing portion of said slide guide externally of said reinforcing portion.

2. The sideshifting carriage of claim 1 wherein said reinforcing portion of said slide guide and said first lip are formed monolithically as a single member.

3. The sideshifting carriage of claim 1 wherein said motor is supported by said slide guide independently of said first lip.

4. The sideshifting carriage of claim 1 wherein said motor is located directly forwardly of a downwardly-protruding portion of said slide guide which extends throughout at least a major portion of said length of said slide guide.

5. The sideshifting carriage of claim 1 wherein said second lip protrudes upwardly substantially no further than does said first lip.

6. The sideshifting carriage of claim 1 wherein said second lip is located forwardly of said forwardly-facing lip surface of said first lip, and said reinforcing portion of said slide guide protrudes forwardly to a location vertically beneath at least a portion of said second lip.

7. The sideshifting carriage of claim 1 wherein said sideshifting frame further includes a pair of transversely-spaced end plates depending vertically from said slide, and a transversely-extending member interconnecting said end plates at a location below said slide.

8. A sideshifting carriage for vertically lifting and lowering a forwardly-extending load-handling implement, and selectively shifting said implement transversely, said carriage comprising:

(a) transversely-spaced, vertically-extending side plates;

(b) at least one elongate slide guide transversely fixed to said side plates, said slide guide having a transverse length and a transversely-extending, upwardly-protruding first lip with a rearwardly-facing lip surface and a forwardly-facing lip surface, said slide guide further having a transversely-extending reinforcing portion protruding forwardly from beneath said forwardly-facing lip surface throughout at least a major portion of said length of said slide guide;

(c) a sideshifting frame including at least one transversely-extending slide which is slidably supported by said rearwardly-facing lip surface so as to be movable transversely with respect to said slide guide, said slide having a transversely-extending, upwardly-protruding, implement-supporting second lip thereon;

(d) a sideshifting motor engaging said sideshifting frame so as to move said frame transversely with respect to said slide guide; and (e) a downwardly-protruding portion of said slide guide which protrudes downwardly from said reinforcing portion throughout at least a major portion of said length of said slide guide, said reinforcing portion protruding forwardly from said downwardly-protruding portion.

9. The sideshifting carriage of claim 8 wherein said motor is supported by said slide guide independently of said first lip.

10. The sideshifting carriage of claim 8 wherein said motor is mounted beneath said reinforcing portion of said slide guide externally thereof and forwardly of said downwardly-protruding portion of said slide guide.

11. The sideshifting carriage of claim 8 wherein said second lip protrudes upwardly substantially no further than does said first lip.

12. The sideshifting carriage of claim 8 wherein said second lip is located forwardly of said forwardly-facing lip surface of said first lip, and said reinforcing portion of said slide guide protrudes forwardly to a location vertically beneath at least a portion of said second lip.

13. The sideshifting carriage of claim 8 wherein said sideshifting frame further includes a pair of transversely-spaced end plates depending vertically from said slide, and a transversely-extending member interconnecting said end plates at a location below said slide.

14. The sideshifting carriage of claim 8 wherein said reinforcing portion of said slide guide and said downwardly-protruding portion of said slide guide are formed monolithically as a single member.

* * * * *